US007303524B2

(12) United States Patent
Brunow et al.

(10) Patent No.: US 7,303,524 B2
(45) Date of Patent: Dec. 4, 2007

(54) FOLDER UNIT FOR PROCESSING SHEET-LIKE MATERIALS

(75) Inventors: Michael J. Brunow, LaVista, NE (US); Dave Hamilton, Carter Lake, IA (US); Frank Dlugosz, Omaha, NE (US); Calvin Mueller, Omaha, NE (US)

(73) Assignee: First Data Corporation, Greenwood Village, CO (US)

( * ) Notice: Subject to any disclaimer, the term of this patent is extended or adjusted under 35 U.S.C. 154(b) by 0 days.

(21) Appl. No.: 11/182,510

(22) Filed: Jul. 14, 2005

(65) Prior Publication Data

US 2007/0015650 A1 Jan. 18, 2007

(51) Int. Cl.
*B31F 1/08* (2006.01)

(52) U.S. Cl. ..... 493/448; 493/405; 493/411; 493/357; 493/413; 270/39.05

(58) Field of Classification Search ..... 493/405, 493/411, 413, 448, 357; 270/39.01, 40, 39.02, 270/39.05

See application file for complete search history.

(56) References Cited

U.S. PATENT DOCUMENTS 4,512,561 A 4/1985 Ury
4,708,332 A * 11/1987 Besemann ..... 270/39.05
4,842,572 A * 6/1989 Roth ..... 493/357
4,871,157 A * 10/1989 Hermann et al. ..... 270/39.02
5,049,121 A * 9/1991 Bunch, III ..... 493/357
5,090,678 A 2/1992 Green
5,110,101 A 5/1992 Roth
5,149,075 A 9/1992 Crowley et al.
5,348,277 A 9/1994 Crowley
5,360,213 A * 11/1994 Crowley et al. ..... 270/39.05
5,383,130 A * 1/1995 Kalisiak ..... 700/224
5,558,318 A * 9/1996 Crowley et al. ..... 270/39.05

OTHER PUBLICATIONS

ESP, Energy Saving Products. "ESP500 Forms Fold Processor" Product Brochure. [online]. [Retrieved on Oct. 12, 2005] <URL: www.espcorp.com> 1 page total.
ESP, Energy Saving Products. "Options for the ESP500 Forms Fold Processor" Product Brochure. [online]. [Retrieved on Oct. 12, 2005] <URL: www.espcorp.com> 2 pages total.
ESP Products. "ESP500 Forms Fold Processor. Features & Benefits" [online]. [Retrieved on Oct. 12, 2005] <URL: http://www.espcorp.com/site/products/Default.asp?ESP=500&Page=products> 2 pages total.

* cited by examiner

*Primary Examiner*—Hemant M. Desai
(74) *Attorney, Agent, or Firm*—Townsend and Towsend and Crew LLP

(57) ABSTRACT

Methods and devices for folding a continuous web of material are provided. Systems can include a spiral folder assembly having first and second sets of rotatable spirals, a deflection means to guide the continuous web toward the first set of spirals and the second set of spirals, a beater assembly to urge the continuous web against the first set of spirals to form a first fold in the web against the second set of spirals to form a second fold in the web, and a conveyor assembly to receive and transport the folded continuous web as it exits the spiral folder assembly, the conveyor assembly providing a support between the first and second sets of spirals, the support modulating an amount of sag in the continuous web as the web is suspended between the first and second sets of spirals.

14 Claims, 6 Drawing Sheets

FOLDER UNIT FOR PROCESSING SHEET-LIKE MATERIALS

CROSS-REFERENCES TO RELATED APPLICATIONS

Not Applicable

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The invention relates generally to sheet processing equipment, and more specifically to systems and methods for folding sheets, statements, and/or inserts prior to mailing.

Transactional printers, mail houses, and financial institutions such as credit card companies mail literally millions of documents within the United States each week. For example, credit card customers can expect to receive a monthly statement summarizing their charges for the prior month, or longer. The credit card companies, or other parties that prepare the mailings for them, are constantly on the lookout for improvements in efficiency, speed, and cost savings. Even incremental improvements in processing speed or efficiency can produce large benefits due to the huge number of mailings.

Sheet processing modules such as spiral folders are useful for processing continuous webs of paper, and are frequently an important component of mail processing systems. Yet currently used spiral folder systems and methods often suffer from significant operational drawbacks. For example, excessive sagging may occur in the center of the folded sheet stack between the spirals. This is particularly true when atypically thin or flexible material is processed in the module. Such sagging can cause the sheet to become misaligned in the sheet processing module, and can lead to paper jams, damaged forms, and the like. These failures can be costly, due to hours of machine downtime and lost operator time. To address these issues, some have suggested shortening the form length of the folded sheet, however such solutions can result in the beater assembly colliding with the chute assembly, again leading to misalignment of the sheet. Relatedly, others have proposed adjusting the beater assembly timing, but this can cause problems when different forms are loaded in the folder module. What is more, in some cases these solutions are not effective due to operator error in adjusting the form length setting or the beater timing.

In light of the above, it would be desirable to provide improved sheet processing systems and methods, particularly for processing components such as folding assemblies. The present invention addresses such needs.

BRIEF SUMMARY OF THE INVENTION

The present invention provides sheet processing methods and systems that can be used with customer documents such as invoices and the like. These techniques may be particularly useful in preventing or reducing the frequency of unwanted system failures. Advantageously, the present invention provides sheet folding systems for continuous web materials having highly reliable folding configurations for long-lasting operation times with minimal downtime due to paper jams and other problems associated with paper misalignment.

In a first aspect, the present invention provides a folder system for folding a continuous web of material. The system can include a spiral folder assembly having a first set of rotatable spirals and a second set of rotatable spirals, a chute assembly that alternates between a first position and a second position, the chute assembly configured to guide the continuous web toward the first set of spirals when in the first position and toward the second set of spirals when in the second position, a beater assembly having a first beater adapted to urge the continuous web against the first set of spirals to form a first fold in the web, and a second beater adapted to urge the continuous web against the second set of spirals to form a second fold in the web, and a conveyor assembly configured to receive and transport the folded continuous web as it exits the spiral folder assembly, the conveyor assembly providing a support disposed between a first vertical plane defined by the first set of spirals and a second vertical plane defined by the second set of spirals, the support adapted to modulate an amount of sagging in the continuous web as the web is suspended between the first set of spirals and the second set of spirals. In some embodiments, the conveyor assembly includes a plurality of support rollers coupled with a support frame, and a support belt circumferentially wrapped about the plurality of support rollers.

In related embodiments, the support can be defined by at least one of the plurality of support rollers. The plurality of support rollers may define a horizontal path that extends at least one half of a horizontal distance between the first vertical plane defined by the first set of spirals and the second vertical plane defined by the second set of spirals. In some embodiments, the conveyor assembly includes a plurality of support rollers that define a substantially horizontal plane, and a support belt circumferentially wrapped about the plurality of support rollers. The conveyor assembly may also include a ramp roller, a plurality of exit rollers, a ramp belt circumferentially wrapped about the ramp roller and at least one of the plurality of exit rollers, and an exit belt circumferentially wrapped about the plurality of exit rollers. The plurality of support rollers and the ramp roller can be coupled with a support frame, and the support can be defined by at least one of the plurality of support rollers and the ramp roller. In some embodiments, the conveyor assembly may include a drive belt coupled with the ramp roller and a drive means, and a transfer belt coupled with the ramp roller and a support roller adjacent to the ramp roller. In still further embodiments, the folder system can include a first stop bar configured to restrain movement of the continuous web when the web is urged against the first set of spirals by the first beater, and a second stop bar configured to restrain movement of the continuous web when the web is urged against the second set of spirals by the second beater.

In another embodiment, the present invention provides a method for folding a continuous web of material. The method can include directing the continuous web of material with a chute assembly that alternates between a first position and a second position, guiding the continuous web toward a first set of rotatable spirals of a spiral folder assembly when the chute assembly is in the first position, guiding the continuous web toward a second set of rotatable spirals of the spiral folder assembly when the chute assembly is in the second position, urging the continuous web against the first set of spirals with a first beater of a beater assembly to form a first fold in the web, and urging the continuous web against the second set of spirals with a second beater of the beater assembly to form a second fold in the web, advancing the folded continuous web from the spiral folder assembly toward a conveyor assembly, and supporting the folded continuous web with a support of the conveyor assembly to modulate an amount of sagging in the continuous web as the web is suspended between the first set of spirals and the second set of spirals. In some embodiments, the method includes transporting the folded continuous web with the conveyor assembly by rotating a support belt circumferentially wrapped about a plurality of support rollers. The method may also include supporting the folded continuous web with at least one of the plurality of support rollers as the web is suspended between the first set of spirals and the second set of spirals.

In related embodiments, the plurality of support rollers may define a horizontal path that extends at least one half of a horizontal distance between a first vertical plane defined by the first set of spirals and a second vertical plane defined by the second set of spirals. The method may also include transporting the folded continuous web with the conveyor assembly in a downstream direction from the support rollers by rotating a ramp belt circumferentially wrapped about a ramp roller and at least one of a plurality of exit rollers. In some embodiments, the method may include advancing the folded continuous web from the spiral folder assembly onto a support belt circumferentially wrapped about a plurality of support rollers, the plurality of support rollers that define a substantially horizontal plane, rotating the support belt to advance the folded continuous web from the support belt onto a ramp belt circumferentially wrapped about a ramp roller and at least one of a plurality of exit rollers, and rotating the ramp belt to advance the folded continuous web from the ramp belt onto an exit belt circumferentially wrapped about the plurality of exit rollers.

The method may also include activating a drive means to rotate the ramp roller, and rotating a support roller adjacent to the ramp roller via a transfer belt coupled with the ramp roller and the support roller adjacent to the ramp roller. In some embodiments, the method includes restraining movement of the continuous web with a first stop bar when the web is urged against the first set of spirals by the first beater, and restraining movement of the continuous web with a second stop bar when the web is urged against the second set of spirals by the second beater. In related embodiments, the continuous web may include a sheet having a plurality of perforations, and the method may include folding the sheet along each of the plurality of perforations.

In yet another aspect, the present invention provides a method of constructing a folder system for folding a continuous web of material. The method may include coupling a system frame with a spiral folder assembly having a first set of rotatable spirals and a second set of rotatable spirals, coupling the system frame with a chute assembly that alternates between a first position and a second position, the chute assembly configured to guide the continuous web toward the first set of spirals when in the first position and toward the second set of spirals when in the second position, coupling the system frame with a beater assembly having a first beater adapted to urge the continuous web against the first set of spirals to form a first fold in the web, and a second beater adapted to urge the continuous web against the second set of spirals to form a second fold in the web, and coupling the system frame with a conveyor assembly configured to receive and transport the folded continuous web as it exits the spiral folder assembly, the conveyor assembly providing a support disposed between a first vertical plane defined by the first set of spirals and a second vertical plane defined by the second set of spirals, the support adapted to modulate an amount of sagging in the continuous web as the web is suspended between the first set of spirals and the second set of spirals. In a related embodiment, the method of constructing the conveyor assembly can include coupling a plurality of support rollers with a support frame, and circumferentially wrapping a support belt about the plurality of support rollers, the plurality of support rollers defining a horizontal path that extends at least one half of a horizontal distance between a first vertical plane defined by the first set of spirals and a second vertical plane defined by the second set of spirals. In some embodiments, the method can include coupling a plurality of support rollers with a support frame, and circumferentially wrapping a support belt about the plurality of support rollers, coupling a ramp roller with the support frame, coupling a plurality of exit rollers with the system frame, circumferentially wrapping a ramp belt about the ramp roller and at least one of the plurality of exit rollers, and circumferentially wrapping an exit belt about the plurality of exit rollers. In related embodiments, the method can include coupling the system frame with a first stop bar configured to restrain movement of the continuous web when it is urged against the first set of spirals, and a second stop bar configured to restrain movement of the continuous web when it is urged against the second set of spirals.

DETAILED DESCRIPTION OF THE INVENTION

The present invention will find application in a wide variety of web processing environments. The systems and methods disclosed herein are useful for preventing, inhibiting, or otherwise addressing excessive or unwanted sag in sheet-like materials as they are advanced through processing systems. For example, the present invention can effectively process lightweight grades of paper (16 lb) with a large distance between perforations (14 in.) which may otherwise exhibit unwanted sag when processed using currently known systems. Advantageously, the present techniques can prevent or inhibit the exit side of a folded stack from pulling away from the stops during stack processing, and can also prevent or inhibit placement of the perforated line behind the exit beaters, both of which may occur with other known approaches for dealing with excessive sag. Relatedly, the present invention is also useful for preventing the beaters from colliding with the swing chute, and for preventing the entrance side of the folded stack from buckling against the entrance stops, which are drawbacks of present systems when they are adjusted to a different form length setting in an attempt to deal with excessive sag. Relatedly, the present invention is useful for preventing timing problems when different forms are loaded, which occurs, for example, when the exit beater timing is adjusted to help catch the perforated line.

The instant invention can provide greater support to a folded stack when compared to known systems. The instant invention can also help to maintain the perforated lines or folds closer to the folder stops. It can reduce the need to adjust form length setting and beater timing, the time needed to set-up the folder module, and the amount of damaged forms due to paper jams.

Figure 1:
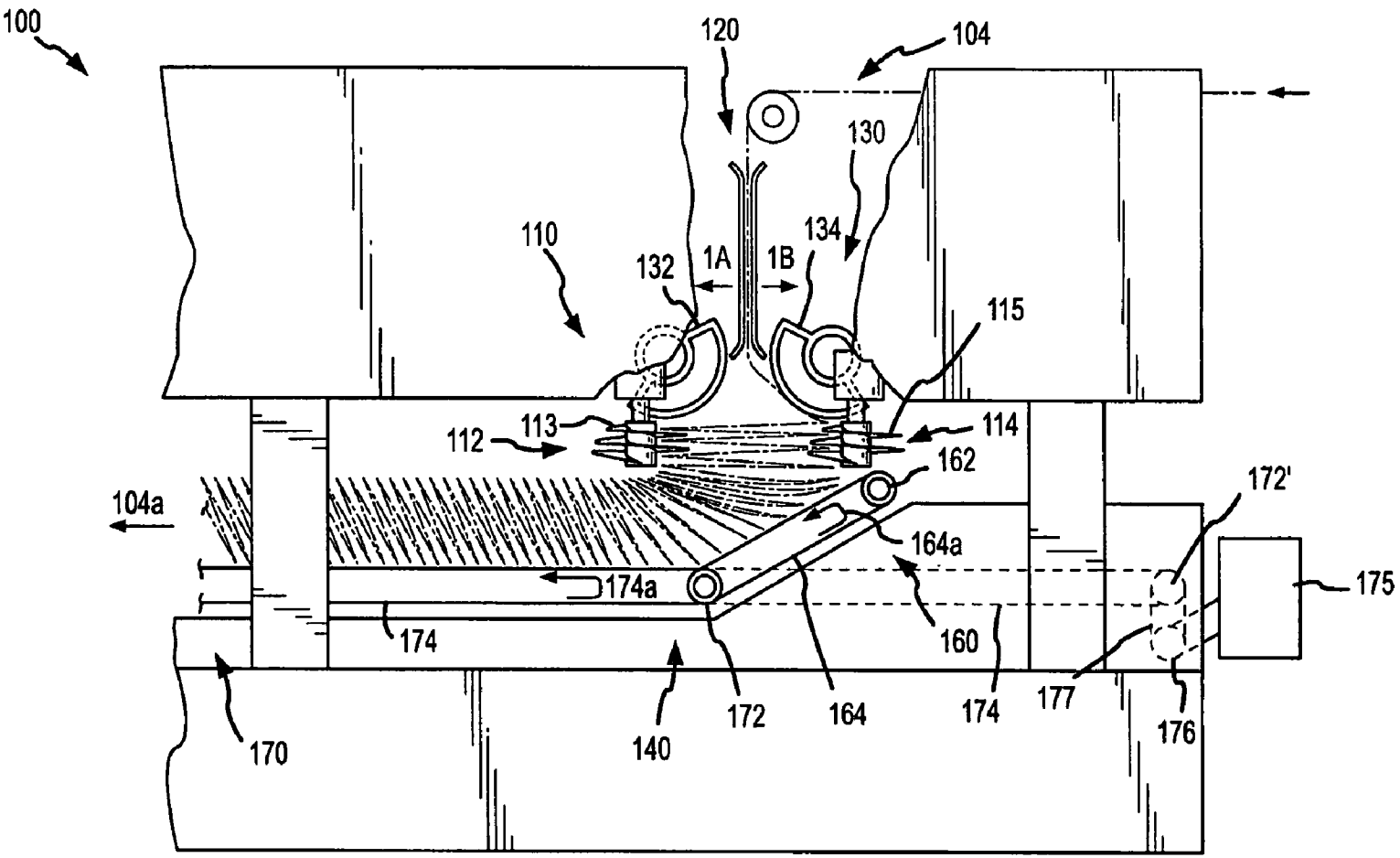
FIG. 1 PRIOR ART
FIG. 1 illustrates a cut-away side view of a known sheet folder system.

Turning now to the figures, FIG. 1 shows a known sheet folder system 100 adapted for folding a continuous web of paper 104. System 100 includes a spiral folder assembly 110, a chute assembly 120, a beater assembly 130, and a conveyor assembly 140. In operation, chute assembly 120 swings back and forth between a first set of spirals 112 and a second set of spirals 114. When in a first position indicated by arrow 1A, chute assembly 120 feeds continuous web 104 toward first set of spirals 112. A first beater 132 acts to urge web 104 against first set of spirals 112 so as to form a first fold in web 104 as it engages spiral blade 113. Thereafter, when in a second position indicated by arrow 1B, chute assembly 120 feeds continuous web 104 toward second set of spirals 114. A second beater 134 acts to urge web 104 against second set of spirals 114 so as to form a second fold in web 104 as it engages spiral blade 115. Often, first and second folds correspond to perforations that are present in web 104. During this process, web 104 is continuously advanced through chute assembly 120 as it swings back and forth between positions 1A and 1B, and spirals 112 and 114 are rotated about their own axes to advance the paper folds in a downward direction, such that an accordion-type fold is created in web 104. Companies that market such known folders include Energy Saving Products (ESP) of Burlington, Conn. (e.g. Model No. ESP500 Forms Fold Processor) and B. Bunch Co., Inc. of Phoenix, Ariz.

When the folded web 104 leaves the spiral folder assembly 110, it falls to rest on one or more rotating ramp belts 164 of ramp arrangement 160, which are wrapped circumferentially about a ramp roller 162 and an exit roller 172. As seen from this perspective, ramp belt 164 rotates in a counter-clockwise direction, illustrated by arrow 164*a*. Typically, rotation of exit roller 172' is driven by a drive chain 177 which is coupled with a drive motor 175 via a drive sprocket 176. Drive motor 175 can be any of a variety of motors, such as those marketed by Zero-Max, Inc. of Plymouth, Minn. Rotation of exit roller 172' causes exit belt to circumferentially rotate about exit rollers 172, 172'. One of the exit rollers 172 is coupled with ramp roller via ramp belt 164. Rotating ramp belt 164 operates to advance the folded web 104 from spiral folder assembly 110 toward one or more rotating exit belts 174 of exit arrangement 170. As seen from this perspective, exit belt 174, which is wrapped circumferentially about a plurality of exit rollers 172, 172', rotates in a counter-clockwise direction, illustrated by arrow 174*a*. Typically, exit belt 174 of conveyor assembly 140 acts to advance the folded web 104 toward another downstream processing location as indicated by arrow 104*a*.

Figure 2:
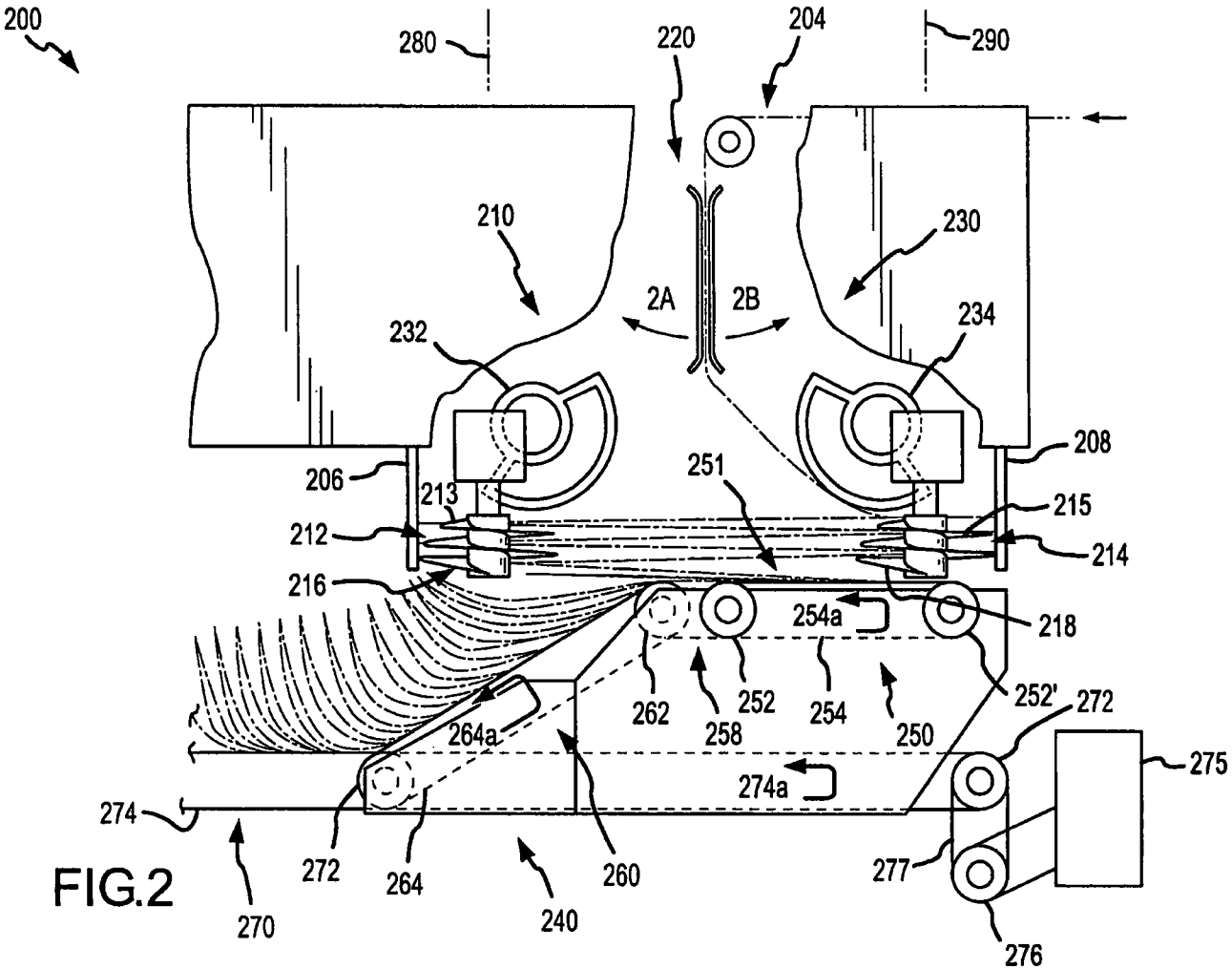
FIG. 2 illustrates a cut-away side view of a sheet folder system according to one embodiment of the present invention.

FIG. 2 illustrates a sheet folder system 200 according to one embodiment of the present invention. Folder system 200 is provided for folding a continuous web of sheet-like material 204. System 200 includes a spiral folder assembly 210, a chute assembly 220, a beater assembly 230, and a conveyor assembly 240. According to some embodiments, conveyor assembly may include a support arrangement 250, a ramp arrangement 260, and an exit arrangement 270. In operation, chute assembly 220 swings back and forth between a first set of spirals 212 and a second set of spirals 214. It is appreciated that chute assembly 220 represents one of a variety of deflection means contemplated by the present invention, whereby the deflection means operates to steer, direct, or otherwise move web 204 in the desired direction. When in a first position indicated by arrow 2A, chute assembly 220 feeds continuous web 204 toward first set of spirals 212. A first beater 232 acts to urge web 204 against first set of spirals 212 so as to form a first fold in the web. Thereafter, when in a second position indicated by arrow 2B, chute assembly 220 feeds continuous web 204 toward second set of spirals 214. A second beater 234 acts to urge web 204 against second set of spirals 214 so as to form a second fold in the web. Often, the continuous web is prepared so as to provide perforations where the folds are to be made. System 200 often includes one or more first stop bars 206 configured to restrain movement of continuous web 204 when it is urged against first set of spirals 212 by first beater 232, and one or more second stop bars 208 configured to restrain movement of continuous web 204 when it is urged against second set of spirals 214 by second beater 234.

As noted previously, the present invention can prevent or inhibit the folded stack from pulling away from stops 206 and/or 208, such that web folds/perforations are kept close to or at stops 206, 208. Often, beater timing involves a leading edge of beater 232, 234 being disposed about 0.75 inches from its respective stop 206, 208, so beater 232, 234 will have ample time to force the perforated line to collapse and create a fold. Accordingly, the present invention can inhibit or prevent the perforations and/or folds from being placed at inappropriate locations relative to beaters 232 and/or 234 during web processing. For example, without the necessary support at the lower center of the folded stack, the sagging will shorten the overall horizontal distance between the perforated lines at spirals 212 and perforated lines at spirals 214. If the perforated lines are not close enough to stops 206, 208, then beater 232, 234 may not be able to effectively collapse the perforated line to cause a fold. In known systems, such as those shown in FIG. 1, this can be a significant problem because ramp roller 162 at best supports the very end of the folded stack, at spirals 114, and therefore the perforations are not kept sufficiently close to the stop (not shown) located at spirals 112, or are otherwise not sufficiently engaged with spirals 112 to allow for proper beater folding. In this sense, the present invention provides devices and methods for ensuring that the web is appropriately engaged with spirals 212, 214, beaters 232, 234, and/or stops 206, 208 so as to correctly create folds in web 204.

During the web processing operation, web 204 can be continuously advanced through chute assembly 220 as it swings back and forth between position 2A and position 2B, and spirals 212 and 214 can be rotated about their own individual axes so that spiral blades 213 and 215 operate to advance the paper folds in a downward direction. This process effectively creates an accordion-type fold or fan fold in web 204. When the folded web 204 leaves the spiral folder assembly 210, it can be supported by a support 251 defined at least in part by a support assembly 250 of conveyor assembly 240. Support assembly 250 can include one or more support rollers 252, 252' and one or more support belts 254, where support belts 254 are wrapped circumferentially about one or more support rollers 252, 252'. In some embodiments, support belts 254 are about 1.5 inches wide and about 0.0625 inches thick, and support rollers 252 are made of aluminum. Often, support 251 will be disposed between a first vertical plane 280 defined by first set of spirals 212 and a second vertical plane 290 defined by second set of spirals 214. Support 251 can be configured so as to prevent or reduce sagging of continuous web 204 as it is suspended between first set of spirals 212 and second set of spirals 214. It is appreciated that the position or orientation of support 251 can be configured in any of a variety of ways. By setting the orientation of various components of conveyor assembly 240, an operator can modulate or adjust the amount of sagging present in folded web 204. In some cases, the conveyor assembly 240 configuration will be a pre-set configuration, based on parameters such as spiral blade depth, web thickness, distance between folds or perforations in the web, and the like. Factors such as these are further discussed below in reference to FIGS. 5A-F.

What is more, the present invention contemplates a wide variety of different configurations for any of the system components, including, but not limited to, spiral folder assembly 210, chute assembly 220, assembly 230, and conveyor assembly 240. For example, conveyor assembly 240 often includes one or more support rollers 252, 252', although in some embodiments a support roller may not be present. Ramp roller 262 may be adapted so as to provide achieve a desired effect of the invention, in the absence of a support roller 252, 252'. Relatedly, an operator may configure support arrangement 250, ramp arrangement 262, and exit arrangement 240 with any desired combination or belts and rollers. As noted previously, such configurations will often provide support 251 so as to reduce or inhibit an amount of sagging present in continuous web 204 as it is suspended or otherwise processed through first set of spirals 212 and second set of spirals 214. In some embodiments, support 251 is disposed along a horizontal plane defined by bottom ends 216 and 218, respectively, of spiral blades 213 and 215. Support 251 may be present in any of a variety of orientations and/or locations at or near this plane, so long as it provides the desired effect on the sag in continuous web 204. In many embodiments, continuous web 204 is processed along a cascade-like web processing path defined by conveyor assembly 240.

As seen from the perspective shown in FIG. 2, support belt 254 rotates in a counter-clockwise direction, illustrated by arrow 254*a*. Similarly, ramp belt 264, which is wrapped circumferentially about a ramp roller 262 and an exit roller 272, rotates in a counter-clockwise direction, illustrated by arrow 264*a*. In some embodiments, rotation of exit roller 272' is driven by a drive chain 277 which is coupled with a drive motor 275 via a drive sprocket 276. Rotation of exit roller 272' causes exit belt to circumferentially rotate about exit rollers 272, 272'. One or more of the exit rollers 272 can be coupled with ramp roller via ramp belt 264. Transfer belt 258 can transfer rotational force from ramp roller 262 to support roller 252. Support belt 254 can transfer rotational force from support roller 252 to other support rollers 252'. Support belt 254 can operate to advance folded web 204 from spiral folder assembly 210 toward one or more ramp belts 264. Ramp belts 264 can operate to advance the folded web 204 from support arrangement 250 toward one or more rotating exit belts 274 of exit arrangement 270. As seen from this perspective, exit belt 274, which is wrapped circumferentially about a plurality of exit rollers 272, 272', rotates in a counter-clockwise direction, illustrated by arrow 274*a*. Typically, exit belt 274 of conveyor assembly 240 acts to advance the folded web 204 toward another downstream processing location.

Figure 3:
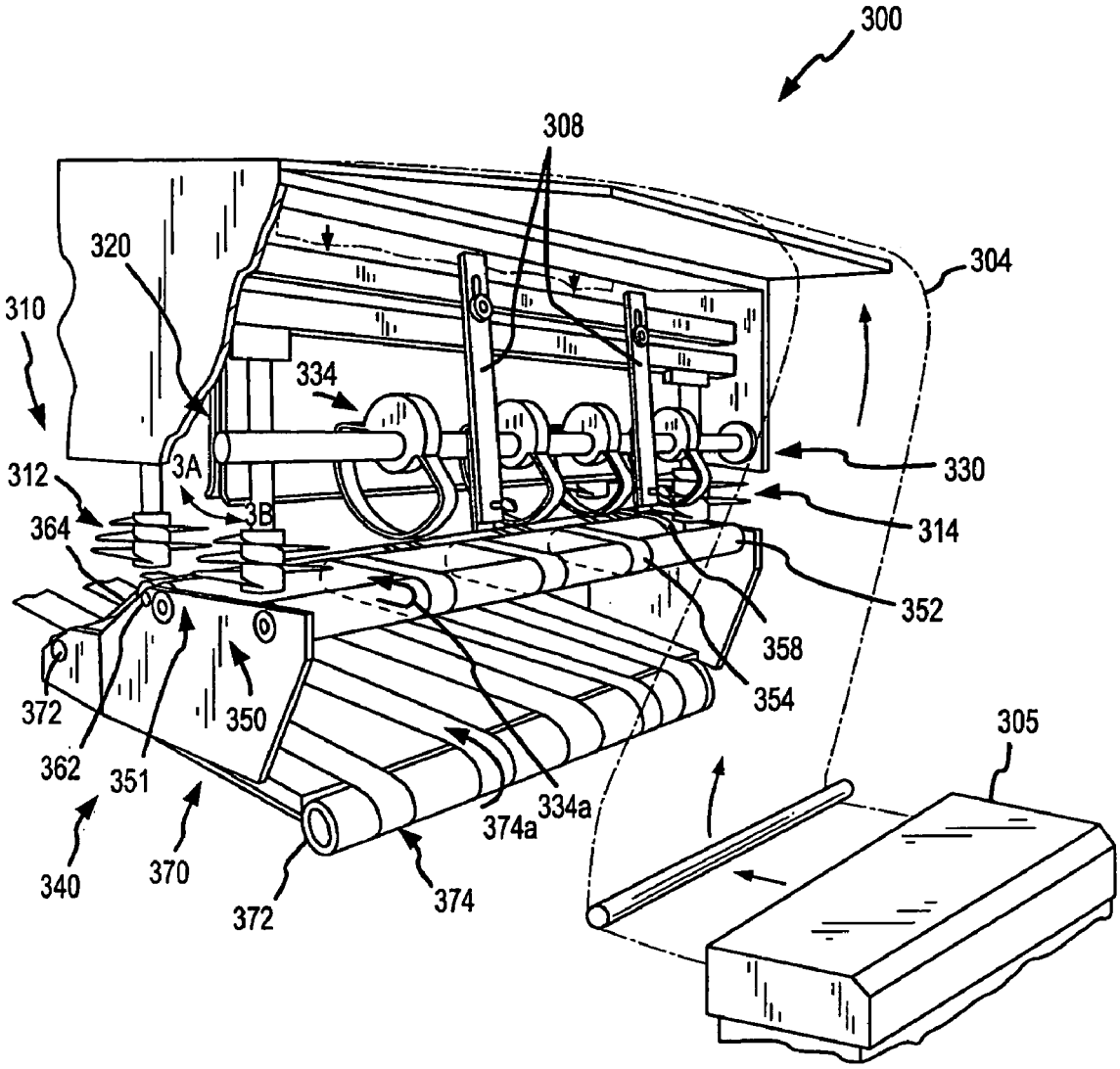
FIG. 3 illustrates a perspective view of a sheet folder system according to one embodiment of the present invention.

FIG. 3 illustrates a sheet folder system 300 according to one embodiment of the present invention. Folder system 300 is provided for folding a continuous web of sheet-like material 304. In some embodiments, web 304 may include a pre-printed roll of paper material, or the like, as produced by a printer system 305 which is operative association with folder system 300. System 300 includes a spiral folder assembly 310, a chute assembly 320, a beater assembly 330, and a conveyor assembly 340. In operation, web 304 is fed into folder system 300 from printer system 305, and chute assembly 320 swings back and forth between a first set of spirals 312 and a second set of spirals 314. When in a first position indicated by arrow 3A, chute assembly 320 feeds continuous web 304 toward first set of spirals 312. A first beater (not shown) acts to urge web 304 against first set of spirals 312 so as to form a first fold in the web. Thereafter, when in a second position indicated by arrow 3B, chute assembly 320 feeds continuous web 304 toward second set of spirals 314. A second beater 334 acts to urge web 304 against second set of spirals 314 so as to form a second fold in the web. During this process, web 304 can be continuously advanced through chute assembly 320 as it swings back and forth between position 3A and position 3B, and spirals 312 and 314 can be rotated about their own individual axes to advance the paper folds in a downward direction, such that an accordion-type fold or fan fold is created in web 304.

When the folded web 304 leaves the spiral folder assembly 310, it can be supported by a support 351 defined at least in part by a support assembly 350 of conveyor assembly 340. Support assembly 350 can include one or more support rollers 352 and one or more support belts 354, where support belts 354 are wrapped circumferentially about one or more support rollers 352. Support assembly 350 may also include a transfer belt 358 wrapped circumferentially about a ramp roller 362 and a support roller 352, configured to transmit rotational force from ramp roller 362 to support roller 352. In some embodiments, transfer belt 358 is made of urethane, and is about 0.5 inches wide and about 0.0625 inches thick.

As seen from the perspective shown in FIG. 3, support belt 354 rotates in a counter-clockwise direction, illustrated by arrow 354*a*. Similarly, ramp belt 364, which is wrapped circumferentially about a ramp roller 362 and an exit roller 372 rotates in a counter-clockwise direction. Support belt 354 can operate to help advance folded web 304 from spiral folder assembly 310 toward one or more ramp belts 364. Ramp belts 364 can operate to advance the folded web 304 from support arrangement 350 toward one or more rotating exit belts 374 of exit assembly 370. As seen from this perspective, exit belt 374, which is wrapped circumferentially about a plurality of exit rollers 372, rotates in a counter-clockwise direction, illustrated by arrow 374*a*. Typically, exit belt 374 of conveyor assembly 340 acts to advance the folded web 304 toward another downstream processing location.

Figure 4:
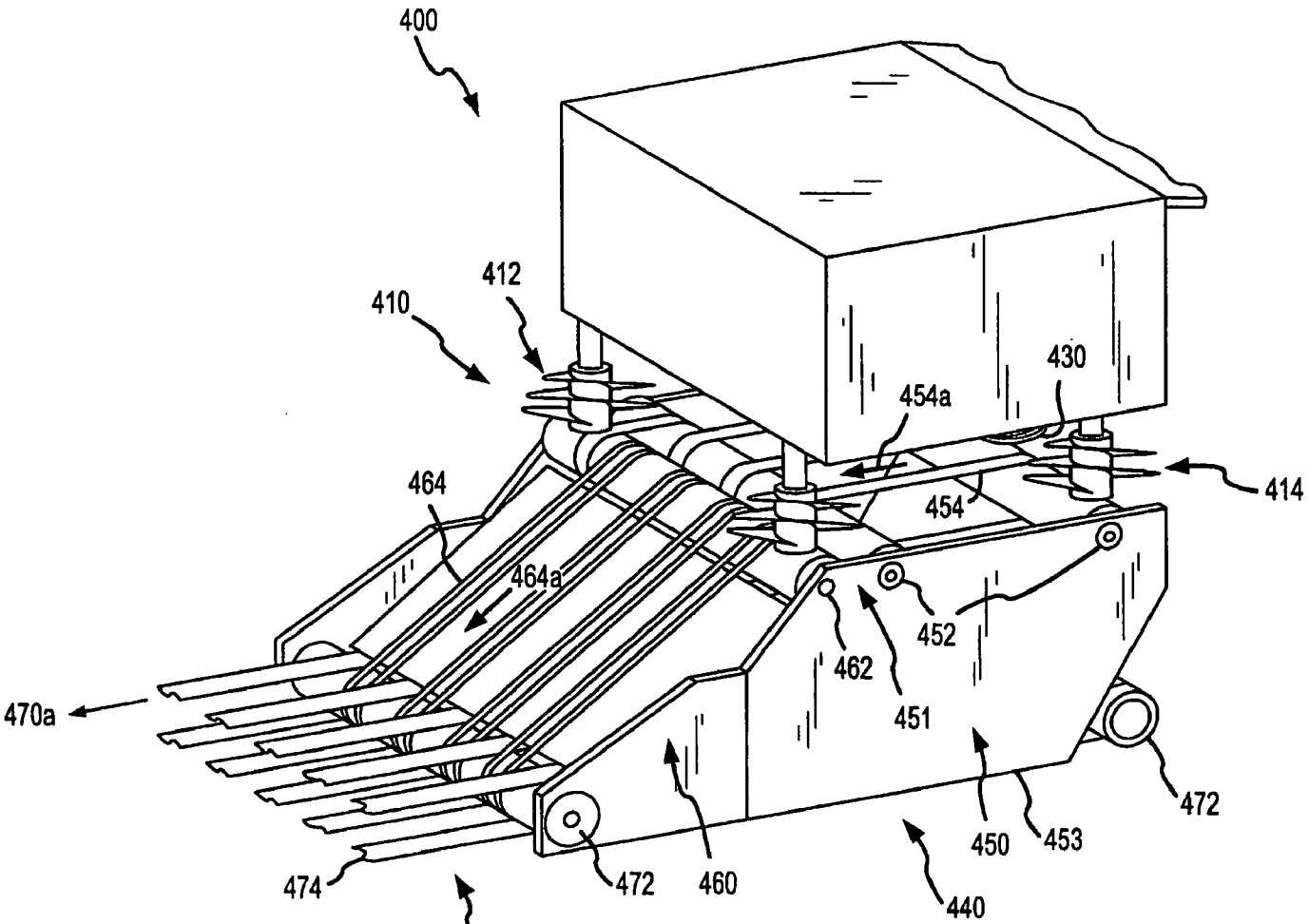
FIG. 4 illustrates a perspective view of a sheet folder system according to one embodiment of the present invention.

FIG. 4 illustrates a sheet folder system 400 according to one embodiment of the present invention. Folder system 400 is provided for folding a continuous web of sheet-like material (not shown). System 400 includes a spiral folder assembly 410, a chute assembly (not shown), a beater assembly 430, and a conveyor assembly 440. When the folded web leaves the spiral folder assembly 410, it can be supported by a support 451 defined by various components of conveyor assembly 440. Conveyor assembly 440 can include a support arrangement 450, a ramp arrangement 460, and an exit arrangement 470. Support assembly 450 can include one or more support rollers 452, two end plates 453, and one or more support belts 454, where support belts 454 are wrapped circumferentially about one or more support rollers 452. Often, support 451 will be disposed between a first vertical plane defined by first set of spirals 412 and a second vertical plane defined by second set of spirals 414. Support 451 can be configured so as to prevent or reduce sagging of continuous web 404 as it is suspended between first set of spirals 412 and second set of spirals 414.

As seen from the perspective shown in FIG. 4, support belt 454 rotates in a counter-clockwise direction, illustrated by arrow 454*a*. Similarly, ramp belt 464, which is wrapped circumferentially about a ramp roller 462 and an exit roller 472 rotates in a counter-clockwise direction, illustrated by arrow 464*a*. Support belt 454 can operate to help advance folded web 404 from spiral folder assembly 410 toward one or more ramp belts 464. Ramp belts 464 can operate to advance the folded web 404 from support arrangement 450 toward one or more rotating exit belts 474 of exit assembly 470. As seen from this perspective, exit belt 474, which is wrapped circumferentially about a plurality of exit rollers 472, rotates in a counter-clockwise direction, illustrated by arrow 474*a*. Typically, exit belt 474 of conveyor assembly 440 acts to advance the folded web 404 toward another downstream processing location.

Figure 5A:
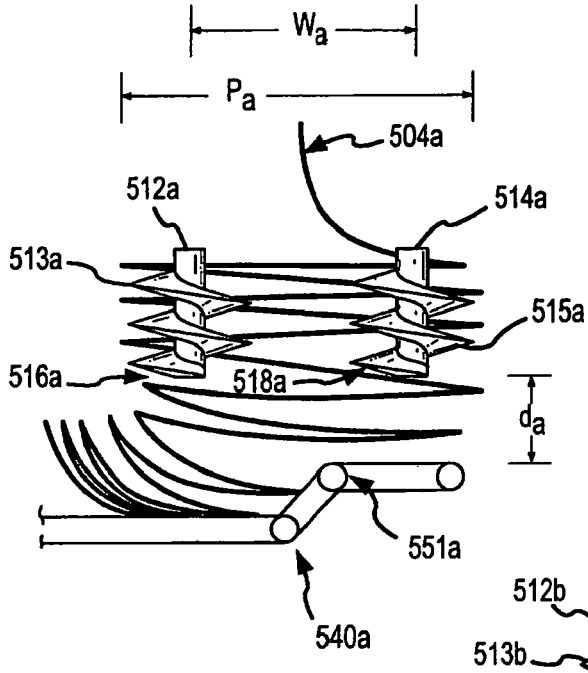
FIGS. 5A-F illustrate spiral folder configurations according to various embodiments of the present invention.
Figure 5B:
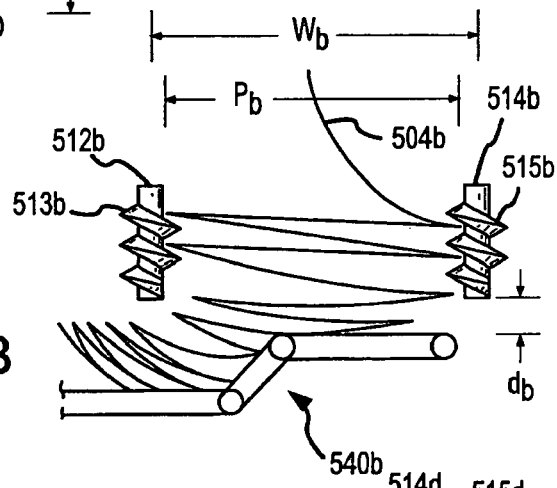

As illustrated in FIGS. 5A-F, the configuration of certain system components may depend on not only the nature of the material being processed but also the nature of other components in the system. As seen in FIG. 5A, distance $d_a$ represents the distance between (i) a portion of support 551*a* and (ii) a horizontal plane defined by bottom ends 516*a* and 518*a*, respectively, of spiral blades 513*a* and 515*a*. A corresponding distance $d_b$ is shown in FIG. 5B. A comparison of FIGS. 5A and 5B reveals that distance $d_a$ is greater than distance $d_b$. Here, the difference may correlate with the fact that the web material 504*a* is thicker than the web material 504*b* and is less likely to sag, and therefore requires less support than web material 504*b*. For example, web material 504*a* may be 20 pound paper stock, whereas web material 504*b* may be 16 pound paper stock. The difference may also correlate with the fact that the distance $p_a$ between perforations and/or folds is less than the distance $p_b$ between perforations and/or folds. For example, distance $p_a$ between perforations and/or folds may be about 10 inches, and distance $p_b$ between perforations and/or folds may be about 14 inches. Table 1 illustrates these associations, as well as other similar associations between the web material and the configuration of certain system components. In many respects, FIGS. 5A and B (side view) correspond with FIGS. 5C and D (top view), respectively.

TABLE 1

| FIG. 5A | | FIG. 5B |
|---|---|---|
| distance $d_a$ | greater than | distance $d_b$ |
| thickness of web 504a | greater than | thickness of web 504b |
| distance $w_a$ between spiral sets 512a and 514a | less than | distance $w_b$ between spiral sets 512b and 514b |
| radius of spiral blades 513a and 515a | greater than | radius of spiral blades 513b and 515b |
| distance $p_a$ between folds and/or perforations | less than | distance $p_b$ between folds and/or perforations |
| contact area between web 504a and spiral blades 513a and 515a | greater than | contact area between web 504b and spiral blades 513b and 515b |

TABLE 1-continued

Figure 5C:
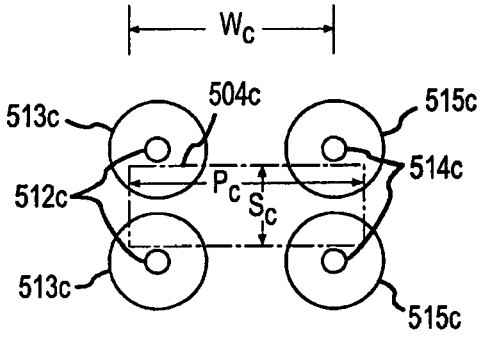
Figure 5D:
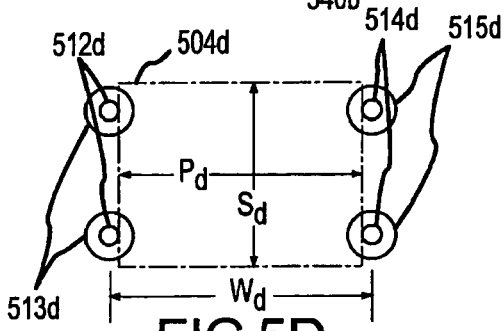

| FIG. 5C | | FIG. 5D |
|---|---|---|
| radius of spiral blades 513c and 515c | greater than | radius of spiral blades 513d and 515d |
| portion of web length $p_c$ that is unsupported by spiral blades 513c and 515c (where $p_c$ is distance between folds and/or perforations) | less than | portion of web length $p_d$ that is unsupported by spiral blades 513d and 515d (where $p_d$ is distance between folds and/or perforations) |
| portion of web span $s_c$ that is unsupported by spiral blades 513c and 515c (where $s_c$ is width of web) | less than | portion of web span $s_d$ that is unsupported by spiral blades 513d and 515d (where $s_d$ is width of web) |
| distance $w_c$ between spiral sets 512c and 514c | less than | distance $w_d$ between spiral sets 512d and 514d |
| contact area between web 504c and spiral blades 513c/515c | greater than | contact area between web 504d and spiral blades 513d/515d |

In some embodiments, the width of the continuous web (e.g. width $s_c$ of web 504*c* shown in FIG. 5C) is about 8.5 inches, about 11 inches, about 14 inches, or about 18 inches. In other embodiments, the width of the continuous web is within a range between about 3.5 inches and about 20 inches. In some embodiments, the distance between perforations and/or folds in the continuous web (e.g. distance $p_c$ of web 504*c* shown in FIG. 5C) is about 8.5 inches, about 10 inches, about 12 inches, or about 14 inches. In some embodiments, the distance between perforations and/or folds in the continuous web is within a range between about 7 inches and about 17 inches. In some embodiments, the paper weight of the continuous web is about 18 pounds or about 24 pounds. In some embodiments, the paper weight of the continuous web is within a range between about 9 pounds and about 200 pounds. In some cases, paper weights can be determined by measuring paper thickness.

Figure 5E:
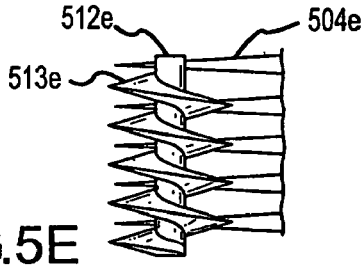
Figure 5F:
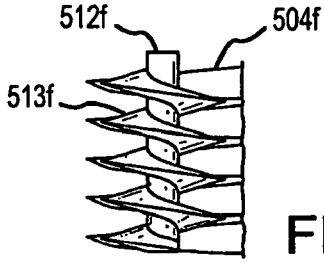

There are a variety of ways in which folds and/or perforations in the continuous web may engage the spiral blades. For example, as shown in FIG. 5E, each consecutive fold at spiral 512*e* is separated by spiral blade 513*e*. In comparison, as shown in FIG. 5F, each individual fold envelopes spiral blade 513*f*, so the top half of the fold is above the blade, and the bottom half of the fold is below the blade.

In many instances conveyor assembly 540*a* will be configured to inhibit sagging that occurs perpendicular to the direction in which web 504*a* travels through the system, as shown in FIG. 5A (e.g. sag between first set spirals 512*a* and second set of spirals 514*a*). It appreciated that conveyor assembly 540*a* may also be configured to inhibit sagging that occurs parallel to the direction in which web 504*a* travels. Various manifestations of web sag can occur depending on the configuration of the folding system and characteristics of the web. The present invention provides means and techniques for addressing any of these types of sag. As noted previously, support 551*a* may be present in any of a variety of orientations and/or locations at or near the horizontal plane defined by bottom ends 516*a* and 518*a* of spiral blades 513*a* and 515*a*, respectively, so long as it provides the desired effect on the sag in continuous web 504*a*.

Figure 6:
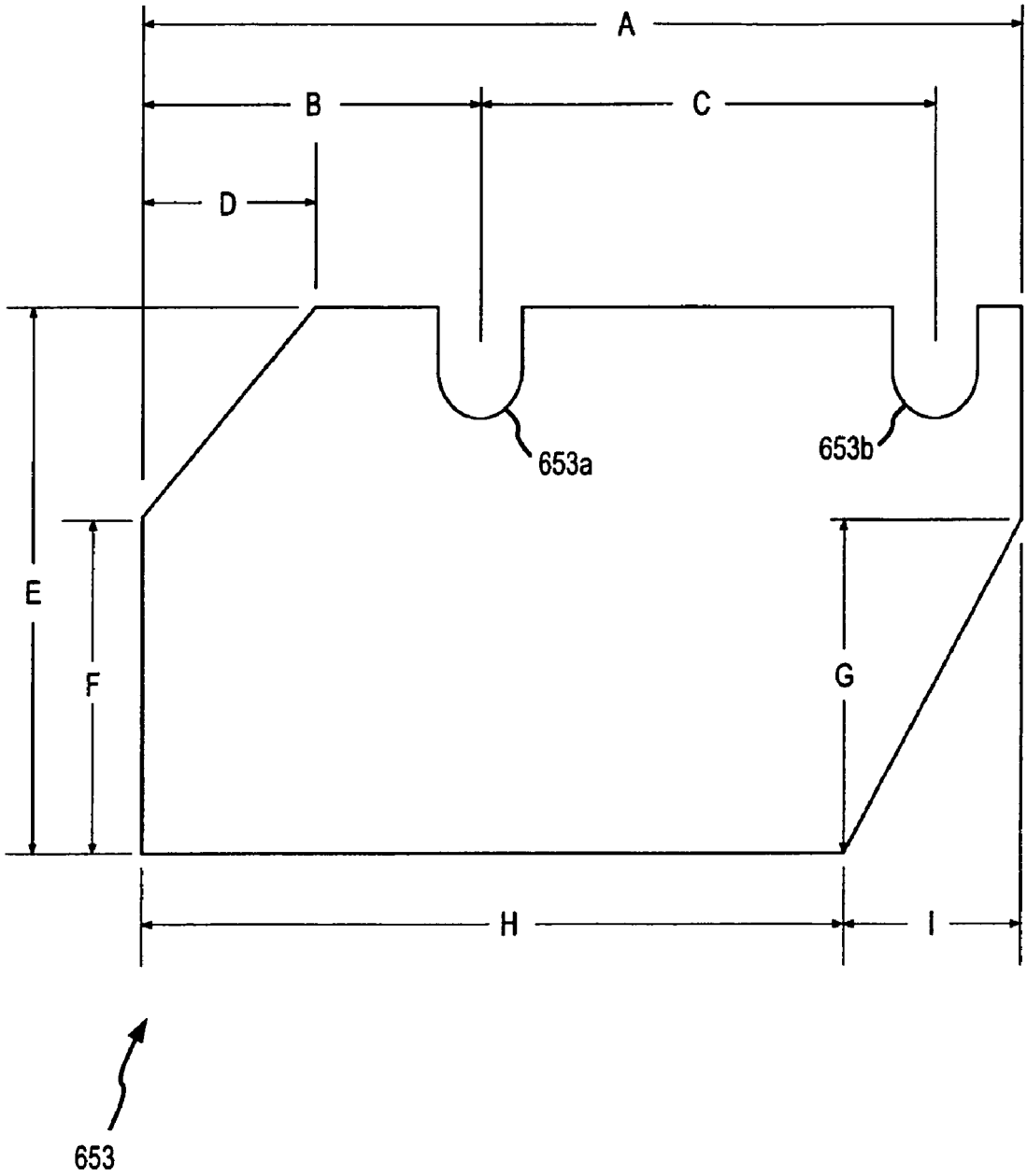
FIG. 6 illustrates a support assembly end plate according to one embodiment of the present invention.

FIG. 6 illustrates a support assembly end plate 653 according to one embodiment of the present invention. Dimensions of end plate 653 can be adapted in any of a variety of ways in order to achieve the desired effect of inhibiting sag in a continuous web. Here, a dimension C represents the distance between a first support roller holder 653*a* and a second support roller holder 653*b*. In some embodiments, dimension C is about 5.25 inches. In some embodiments, dimension C is within a range between about 4.25 inches and about 6.25 inches. In other embodiments, dimension C is within a range between about 3.25 inches and about 7.25 inches. In some embodiments, dimension A is about 10 inches. In some embodiments, dimension A is within a range between about 8 inches and about 12 inches. In other embodiments, dimension A is within a range between about 6 inches and about 14 inches. In some embodiments, dimension B is about 3.75 inches. In some embodiments, dimension B is within a range between about 2.75 inches and about 4.75 inches. In other embodiments, dimension B is within a range between about 1.75 inches and about 5.75 inches.

In some embodiments, dimension D is about 2 inches. In some embodiments, dimension D is within a range between about 1 inch and about 3 inches. In other embodiments, dimension D is within a range between about 0.5 inches and about 3.5 inches. In some embodiments, dimension E is about 4.875 inches. In some embodiments, dimension E is within a range between about 3.875 inches and about 5.875 inches. In other embodiments, dimension E within a range between about 2.875 inches and about 6.875 inches. In some embodiments, dimensions F and G are about 3 inches. In some embodiments, dimensions F and G are within a range between about 2 inches and about 4 inches. In other embodiments, dimensions F and G are within a range between about 1 inch and about 5 inches. In some embodiments, dimension H is about 8 inches. In some embodiments, dimension H is within a range between about 6 inches and about 10 inches. In other embodiments, dimension H is within a range between about 4 inches and about 12 inches. In some embodiments, dimension I is about 2 inches. In some embodiments, dimension I is within a range between about 1 inch and about 3 inches. In other embodiments, dimension I is within a range between about 0.5 inches and about 3.5 inches.

Systems of the present invention often include two end plates 653 for supporting ramp rollers, support rollers, or both. In some embodiments, the distance between end plates 653 is about 20 inches. In some embodiments, the distance between end plates 653 is within a range between about 15 inches and about 25 inches. In other embodiments, the distance between end plates 653 is within a range between about 10 inches and about 30 inches. It is appreciated that end plate 653 can be manufactured from any of a variety of suitable materials. In some embodiments, end plate 653 is made of aluminum, and is about 0.25 inches thick.

While the above provides a full and complete disclosure of certain embodiments of the present invention, various modifications, alternate constructions and equivalents may be employed as desired. Therefore, the above description and illustrations should not be construed as limiting the invention, which is defined by the appended claims.

What is claimed is:

1. A folder system for folding a continuous web of material, the system comprising:

a spiral folder assembly having a first set of rotatable spirals and a second set of rotatable spirals;

a deflection means that alternates between a first position and a second position, the deflection means configured to guide the continuous web toward the first set of spirals when in the first position and toward the second set of spirals when in the second position;

a beater assembly having a first beater to urge the continuous web against the first set of spirals to form a first fold in the web, and a second beater to urge the continuous web against the second set of spirals to form a second fold in the web;

a conveyor assembly configured to receive and transport the folded continuous web as it exits the spiral folder assembly, the conveyor assembly providing a support disposed between a first vertical plane defined by the first set of spirals and a second vertical plane defined by the second set of spirals, the support adapted to modulate an amount of sagging in the continuous web as the web is suspended between the first set of spirals and the second set of spirals; and a first and second stop bars located against the first and second sets of rotatable spirals respectively to restrain movement of the continuous web when the web is urged against the first and second sets of spirals by the first and second beaters respectively.

2. The folder system of claim 1, wherein the conveyor assembly comprises a plurality of support rollers coupled with a support frame, and a support belt circumferentially wrapped about the plurality of support rollers.

3. The folder system of claim 2, wherein the support is defined by at least one of the plurality of support rollers.

4. The folder system of claim 2, wherein the plurality of support rollers define a horizontal path that extends at least one half of a horizontal distance between the first vertical plane defined by the first set of spirals and the second vertical plane defined by the second set of spirals.

5. The folder system of claim 1, the conveyor assembly further comprising:

a plurality of support rollers that define a substantially horizontal plane, and a support belt circumferentially wrapped about the plurality of support rollers;

a ramp roller;

a plurality of exit rollers;

a ramp belt circumferentially wrapped about the ramp roller and at least one of the plurality of exit rollers; and an exit belt circumferentially wrapped about the plurality of exit rollers;

wherein the plurality of support rollers and the ramp roller are coupled with a support frame, and the support is defined by at least one of the plurality of support rollers and the ramp roller.

6. The folder system of claim 5, the conveyor assembly further comprising:

a drive belt coupled with the ramp roller and a drive means; and a transfer belt coupled with the ramp roller and a support roller adjacent to the ramp roller.

7. A method for folding a continuous web of material, the method comprising:

directing the continuous web of material with a deflection means that alternates between a first position and a second position;

guiding the continuous web toward a first set of rotatable spirals of a spiral folder assembly when the deflection means is in the first position, and guiding the continuous web toward a second set of rotatable spirals of the spiral folder assembly when the deflection means is in the second position;

urging the continuous web against the first set of spirals with a first beater of a beater assembly to form a first fold in the web, and urging the continuous web against the second set of spirals with a second beater of the beater assembly to form a second fold in the web;

advancing the folded continuous web from the spiral folder assembly toward a conveyor assembly;

supporting the folded continuous web with a support of the conveyor assembly to modulate an amount of sagging in the continuous web as the web is suspended between the first set of spirals and the second set of spirals; and restraining movement of the continuous web with a first and second stop bars when the web is urged against the first and second sets of spirals by the first and second beaters respectively.

8. The method of claim 7, further comprising transporting the folded continuous web with the conveyor assembly by rotating a support belt circumferentially wrapped about a plurality of support rollers.

9. The method of claim 8, further comprising supporting the folded continuous web with at least one of the plurality of support rollers as the web is suspended between the first set of spirals and the second set of spirals.

10. The method of claim 8, wherein the plurality of support rollers define a horizontal path that extends at least one half of a horizontal distance between a first vertical plane defined by the first set of spirals and a second vertical plane defined by the second set of spirals.

11. The method of claim 8, further comprising transporting the folded continuous web with the conveyor assembly in a downstream direction from the support rollers by rotating a ramp belt circumferentially wrapped about a ramp roller and at least one of a plurality of exit rollers.

12. The method of claim 7, further comprising:

advancing the folded continuous web from the spiral folder assembly onto a support belt circumferentially wrapped about a plurality of support rollers, the plurality of support rollers that define a substantially horizontal plane;

rotating the support belt to advance the folded continuous web from the support belt onto a ramp belt circumferentially wrapped about a ramp roller and at least one of a plurality of exit rollers; and rotating the ramp belt to advance the folded continuous web from the ramp belt onto an exit belt circumferentially wrapped about the plurality of exit rollers.

13. The method of claim 12, further comprising:

activating a drive means to rotate the ramp roller; and rotating a support roller adjacent to the ramp roller via a transfer belt coupled with the ramp roller and the support roller adjacent to the ramp roller.

14. The method of claim 7, wherein the continuous web comprises a sheet having a plurality of perforations, and the method includes folding the sheet along each of the plurality of perforations.

* * * * *